US009700167B1

(12) United States Patent
Nordberg

(10) Patent No.: US 9,700,167 B1
(45) Date of Patent: Jul. 11, 2017

(54) IMPACT RESISTANT MAILBOX SUPPORT APPARATUS

(71) Applicant: Victor Nordberg, Plymouth, MA (US)

(72) Inventor: Victor Nordberg, Plymouth, MA (US)

( * ) Notice: Subject to any disclaimer, the term of this patent is extended or adjusted under 35 U.S.C. 154(b) by 0 days.

(21) Appl. No.: 15/251,290

(22) Filed: Aug. 30, 2016

(51) Int. Cl.
*A47G 29/122* (2006.01)

(52) U.S. Cl.
CPC ..... *A47G 29/1216* (2013.01); *A47G 29/1212* (2013.01)

(58) Field of Classification Search
CPC ..... A47G 29/1216; A47G 29/1212; A47G 29/122; A47G 29/30; A47G 29/1209; A47G 2029/1226; G09F 15/0043; G09F 15/00
USPC ..... 232/39, 38, 17; 248/131, 145, 415, 417; 40/606.06, 566; 362/431
See application file for complete search history.

(56) References Cited

U.S. PATENT DOCUMENTS 2,149,050 A * 2/1939 Hajicck ..... A47G 29/1216 232/39
2,550,338 A * 4/1951 Dunagan ..... A47G 29/1216 126/30
2,605,073 A * 7/1952 Buck ..... A47G 29/1216 232/39
3,161,397 A * 12/1964 Nolander ..... A47G 29/1216 248/417
3,870,262 A * 3/1975 Manning, Jr. ..... A47G 29/1216 232/39
3,899,150 A * 8/1975 Racquet ..... A47G 29/1216 16/76
4,995,576 A * 2/1991 Kieswetter ..... A47G 29/1216 248/145
5,167,364 A * 12/1992 Wenning ..... A47G 29/1216 232/39
5,215,283 A * 6/1993 Gould ..... A47G 29/1216 232/39
5,437,409 A * 8/1995 Coushaine ..... A47G 29/1216 232/39
5,779,202 A * 7/1998 Black ..... A47G 29/1216 232/39
6,047,933 A * 4/2000 Hoover ..... A47G 29/1216 248/145
6,223,982 B1 5/2001 Dunn
7,163,142 B2 1/2007 DeLine et al.
(Continued)

*Primary Examiner* — William Miller
(74) *Attorney, Agent, or Firm* — Stevenson IP, LLC

(57) ABSTRACT

An impact resistant mailbox support apparatus including a mailbox support post and a mailbox having a dome-shaped body, a front door, and an attachment arm hingedly attached to the mailbox support post. The attachment arm has at least one first spring-loaded self-returning hinge. The attachment arm of the mailbox is configured to selectively swing in one of a rightward direction and a leftward direction upon impact and return to an original pre-impact position following impact as a result of the at least one first spring-loaded self-returning hinge. The mailbox support post optionally includes a lower half, an upper half pivotally attached to the lower half, and a second spring-loaded self-returning hinge. The upper half is configured to selectively rotate in one of a rightward direction and a leftward direction upon impact and return to an original pre-impact position following impact as a result of the second spring-loaded self-returning hinge.

3 Claims, 5 Drawing Sheets

(56) References Cited

U.S. PATENT DOCUMENTS

| | | | | |
|---|---|---|---|---|
| 7,353,985 | B1 * | 4/2008 | Weatherholt, II .. | A47G 29/1216<br>232/39 |
| 7,481,357 | B1 * | 1/2009 | Totis ..... | A47G 29/1209<br>232/39 |
| 7,559,457 | B2 | 7/2009 | Webber | |
| 7,954,696 | B2 * | 6/2011 | Wingard ..... | A47G 29/1216<br>232/39 |
| 7,997,545 | B2 * | 8/2011 | Holland ..... | A47G 29/1216<br>232/39 |
| 8,047,423 | B1 * | 11/2011 | Brecht ..... | A47G 29/1216<br>232/39 |
| 8,631,998 | B1 * | 1/2014 | Connelly ..... | A47G 29/1216<br>232/39 |
| 2002/0139904 | A1 * | 10/2002 | Lowell ..... | A47G 29/1216<br>248/145 |

* cited by examiner

IMPACT RESISTANT MAILBOX SUPPORT APPARATUS

BACKGROUND OF THE INVENTION

Various types of mailboxes are known in the prior art. However, what has been needed is an impact resistant mailbox support apparatus including a mailbox support post and a mailbox having a dome-shaped body, a front door, and an attachment arm hingedly attached to the mailbox support post. What has been further needed is for the attachment arm to have at least one first spring-loaded self-returning hinge, such that the attachment arm of the mailbox is configured to selectively swing in one of a rightward direction and a leftward direction upon impact and return to an original pre-impact position following impact as a result of the at least one first spring-loaded self-returning hinge. Lastly, what has been needed is for the mailbox support post to optionally include a lower half, an upper half pivotally attached to the lower half, and a second spring-loaded self-returning hinge. The upper half is configured to selectively rotate in one of a rightward direction and a leftward direction upon impact and return to an original pre-impact position following impact as a result of the second spring-loaded self-returning hinge. The pivotable attachment of each of the mailbox support post and the attachment arm of the mailbox is structurally distinct from other mailboxes and better helps to prevent damage and destruction to a mailbox support post and a mailbox as a result of impact with a vehicle or a snowplow.

FIELD OF THE INVENTION

The present invention relates to mailboxes, and more particularly, to an impact resistant mailbox support apparatus.

SUMMARY OF THE INVENTION

The general purpose of the present impact resistant mailbox support apparatus, described subsequently in greater detail, is to provide an impact resistant mailbox support apparatus which has many novel features that result in an impact resistant mailbox support apparatus which is not anticipated, rendered obvious, suggested, or even implied by prior art, either alone or in combination thereof.

To accomplish this, the present impact resistant mailbox support apparatus includes a cylindrical mailbox support post having a bottom end and a top end. A mailbox has a dome-shaped body, a front door, and an attachment arm hingedly attached to the cylindrical mailbox support post proximal the top end. The attachment arm has at least one first spring-loaded self-returning hinge. The attachment arm of the mailbox is configured to selectively swing in one of a rightward direction and a leftward direction upon impact and return to an original pre-impact position following impact as a result of the at least one first spring-loaded self-returning hinge.

The cylindrical mailbox support post of the impact resistant mailbox support apparatus optionally further includes a lower half, an upper half pivotally attached to the lower half, and a second spring-loaded self-returning hinge. The upper half is configured to selectively rotate in one of a rightward direction and a leftward direction upon impact and return to an original pre-impact position following impact as a result of the second spring-loaded self-returning hinge. The structure of each of the attachment arm of the mailbox and the cylindrical mailbox support post helps to prevent damage and destruction to the cylindrical mailbox support post and the mailbox upon impact with a vehicle or a snowplow. Furthermore, each of the at least one first spring-loaded self-returning hinge and the second spring-loaded self-returning hinge allows for each of the attachment arm of the mailbox and the upper half of the cylindrical mailbox support port, respectively, to pivot in either direction upon impact and immediately return to an original pre-impact position post-impact.

A display is optionally disposed on the upper half of the cylindrical mailbox support post proximal the top end. It is envisioned that the display can include, but not be limited to, a house number. At least one light emitting diode is disposed within the cylindrical mailbox support post behind the display. At least one solar panel is disposed on the top end of the cylindrical mailbox support post. A power inverter is disposed within the cylindrical mailbox support post adjacent to the at least one solar panel, and a battery is disposed within the cylindrical mailbox support post adjacent to the power inverter. The at least one light emitting diode, the at least one solar panel, the power inverter, and the battery are in operational communication with each other. The at least one light emitting diode is configured to illuminate the display. Lastly, a flower box is optionally attached to the cylindrical mailbox support post.

Thus has been broadly outlined the more important features of the present impact resistant mailbox support apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
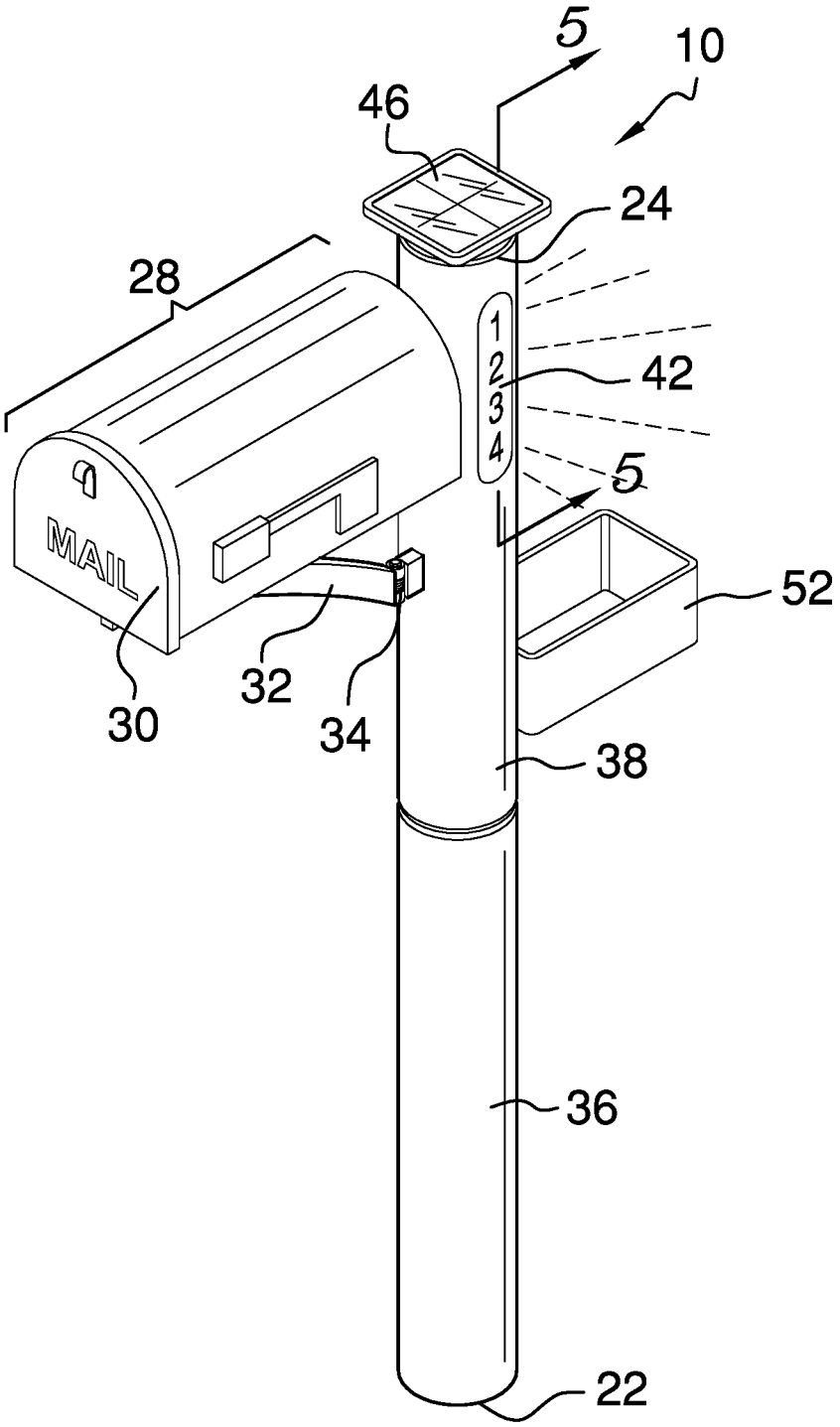
FIG. 1 is a front isometric view.
Figure 2:
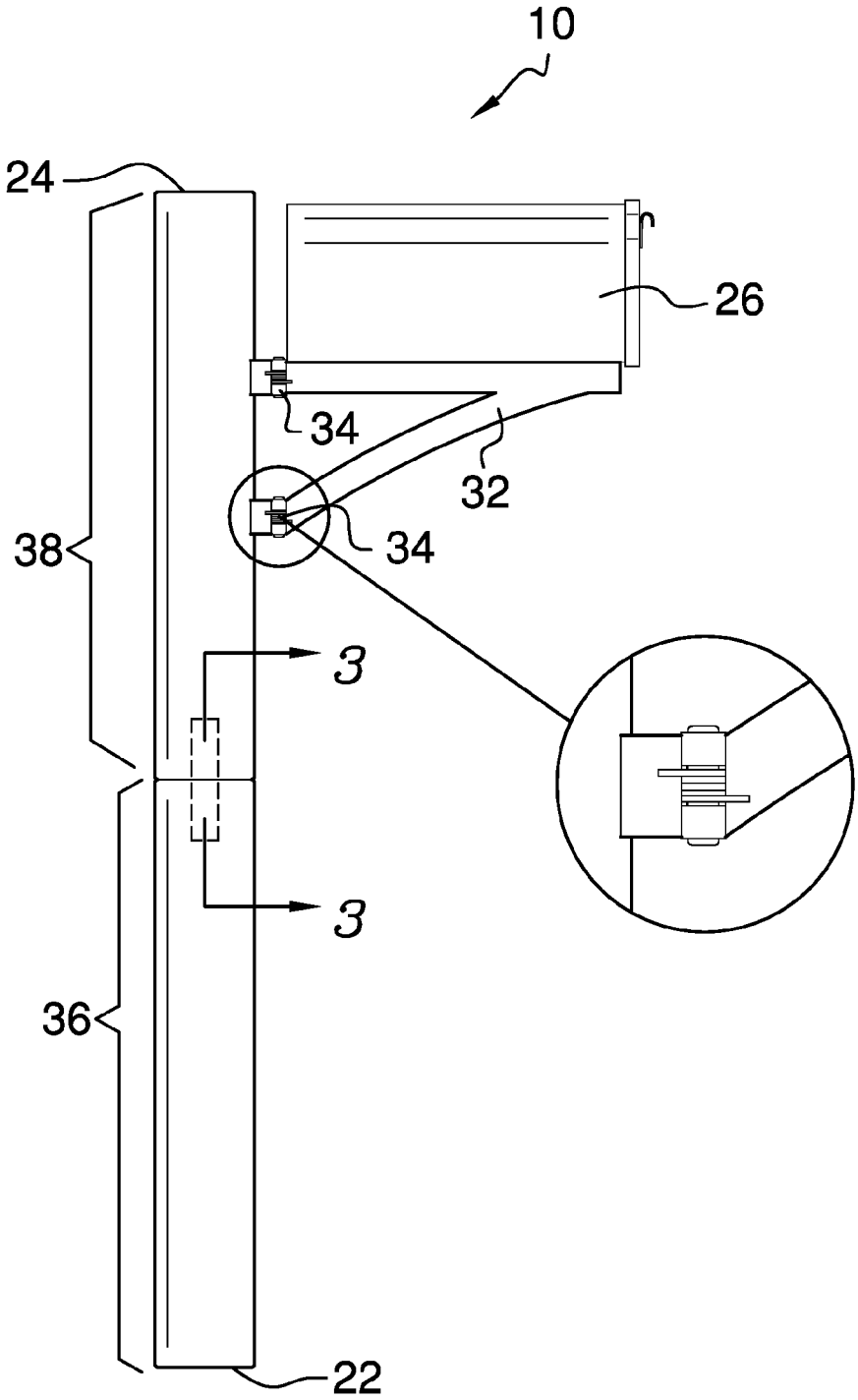
FIG. 2 is a side elevation view.
Figure 3:
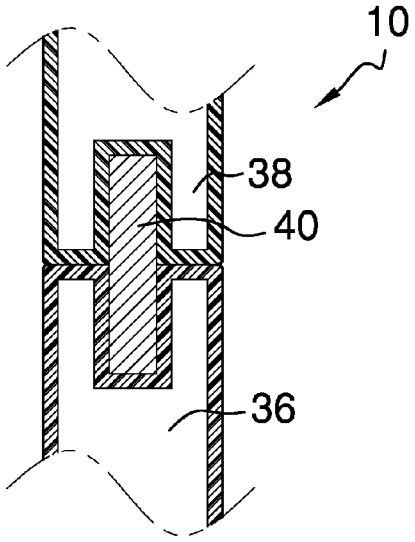
FIG. 3 is a cross-sectional view taken along line 3-3 of FIG. 2.
Figure 4:
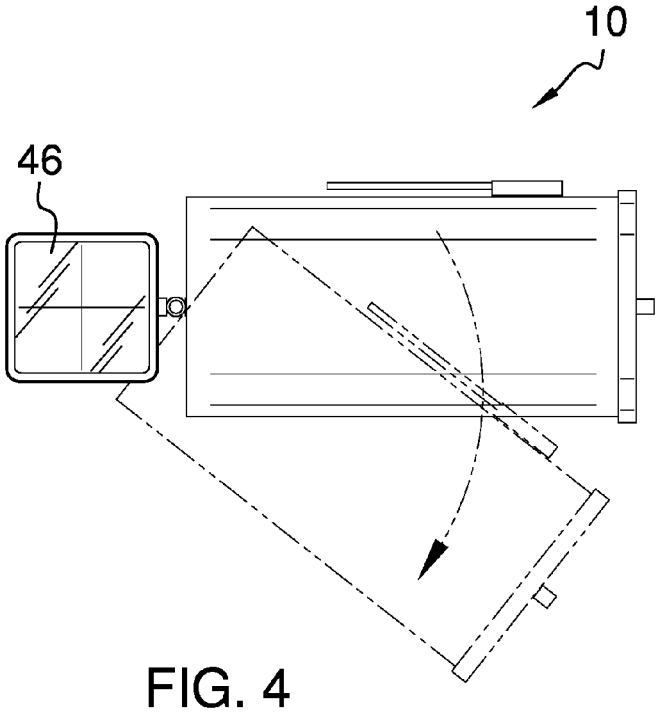
FIG. 4 is a top plan view.
Figure 5:
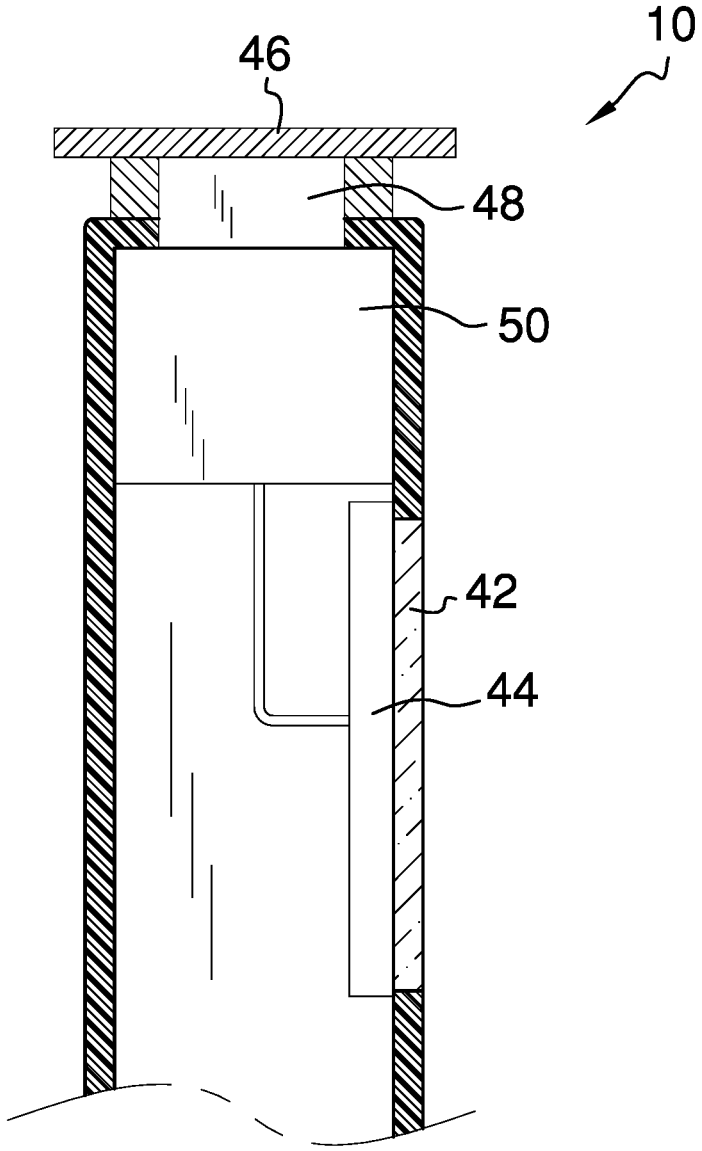
FIG. 5 is a cross-sectional view taken along line 5-5 of FIG. 2.
Figure 6:
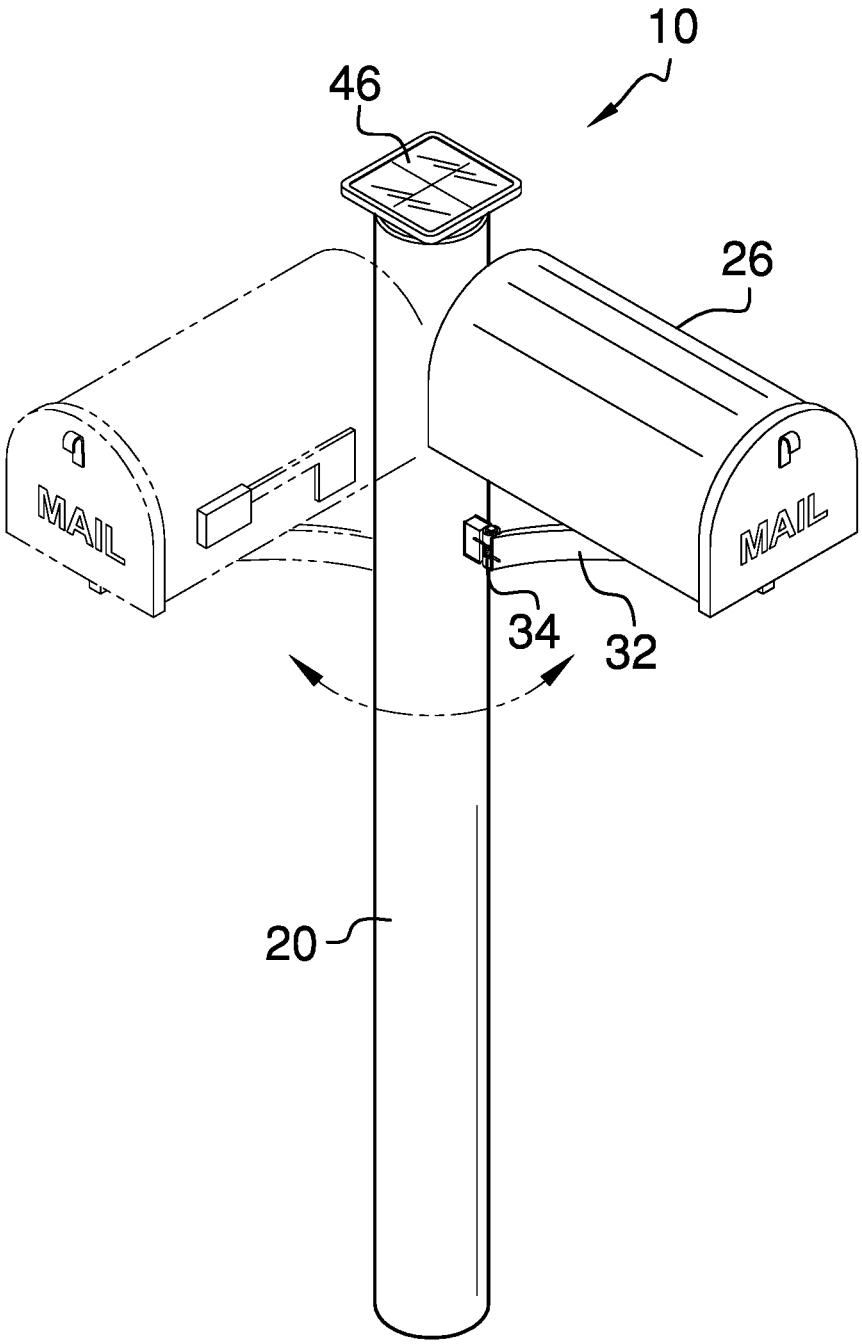
FIG. 6 is an in use view.

With reference now to the drawings, and in particular FIGS. 1 through 6 thereof, an example of the instant impact resistant mailbox support apparatus employing the principles and concepts of the present impact resistant mailbox support apparatus and generally designated by the reference number 10 will be described.

Referring to FIGS. 1 through 6 the present impact resistant mailbox support apparatus 10 is illustrated. The impact resistant mailbox support apparatus 10 includes a cylindrical mailbox support post 20 having a bottom end 22 and a top end 24. A mailbox 26 has a dome-shaped body 28, a front door 30, and an attachment arm 32 hingedly attached to the cylindrical mailbox support post 20 proximal the top end 24. The attachment arm 32 has at least one first spring-loaded self-returning hinge 34. The attachment arm 32 of the mailbox 26 is configured to selectively swing in one of a rightward direction and a leftward direction upon impact and return to an original pre-impact position following impact as a result of the at least one first spring-loaded self-returning hinge 34.

The cylindrical mailbox support post 20 of the impact resistant mailbox support apparatus 10 optionally further includes a lower half 36, an upper half 38 pivotally attached to the lower half 36, and a second spring-loaded self-returning hinge 40. The upper half 38 is configured to selectively rotate in one of a rightward direction and a leftward direction upon impact and return to an original pre-impact position following impact as a result of the second spring-loaded self-returning hinge 40.

A display 42 is optionally disposed on the upper half 38 of the cylindrical mailbox support post 20 proximal the top end 24. At least one light emitting diode 44 is disposed within the cylindrical mailbox support post 20 behind the display 42. At least one solar panel 46 is disposed on the top end 24 of the cylindrical mailbox support post 20. A power inverter 48 is disposed within the cylindrical mailbox support post 20 adjacent to the at least one solar panel 46, and a battery 50 is disposed within the cylindrical mailbox support post 20 adjacent to the power inverter 48. The at least one light emitting diode 44, the at least one solar panel 46, the power inverter 48, and the battery 50 are in operational communication with each other. The at least one light emitting diode 44 is configured to illuminate the display. Lastly, a flower box 52 is optionally attached to the cylindrical mailbox support post 20.

What is claimed is:

1. An impact resistant mailbox support apparatus comprising:

a cylindrical mailbox support post having a bottom end and a top end; and a mailbox having a dome-shaped body, a front door, and an attachment arm hingedly attached to the cylindrical mailbox support post proximal the top end, the attachment arm having at least one first spring-loaded self-returning hinge for hingedly attaching the attachment arm to the cylindrical mailbox support post;

wherein the attachment arm of the mailbox is configured to selectively swing in one of a rightward direction and a leftward direction upon impact and return to an original pre-impact position following impact as a result of the at least one first spring-loaded self-returning hinge;

wherein the cylindrical mailbox support post further comprises a lower half, an upper half pivotally attached to the lower half, and a second spring-loaded self-returning hinge;

wherein the upper half is configured to selectively rotate in one of a rightward direction and a leftward direction upon impact and return to an original pre-impact position following impact as a result of the second spring-loaded self-returning hinge.

2. The impact resistant mailbox support apparatus of claim 1 further comprising:

a display disposed on the upper half of the cylindrical mailbox support post proximal the top end;

at least one light emitting diode disposed within the cylindrical mailbox support post behind the display;

at least one solar panel disposed on the top end of the cylindrical mailbox support post;

a power inverter disposed within the cylindrical mailbox support post adjacent to the at least one solar panel; and a battery disposed within the cylindrical mailbox support post adjacent to the power inverter;

wherein the at least one light emitting diode, the at least one solar panel, the power inverter, and the battery are in operational communication with each other;

wherein the at least one light emitting diode is configured to illuminate the display.

3. The impact resistant mailbox support apparatus of claim 2 further comprising a flower box attached to the cylindrical mailbox support post.

* * * * *